United States Patent [19]

Hays et al.

[11] Patent Number: 4,868,600

[45] Date of Patent: Sep. 19, 1989

[54] SCAVENGELESS DEVELOPMENT APPARATUS FOR USE IN HIGHLIGHT COLOR IMAGING

[75] Inventors: Dan A. Hays, Fairport; William H. Wayman, Ontario; Steven B. Bolte, Rochester, all of N.Y.

[73] Assignee: Xerox Corporation, Stamford, Conn.

[21] Appl. No.: 171,062

[22] Filed: Mar. 21, 1988

[51] Int. Cl.[4] ..... G03G 15/08

[52] U.S. Cl. ..... 355/259; 355/265; 118/653; 430/120

[58] Field of Search ..... 355/3 DD, 140, 3 R; 118/653; 430/120

[56] References Cited

U.S. PATENT DOCUMENTS

| | | | |
|---|---|---|---|
| 3,457,900 | 7/1969 | Drexler | 118/637 |
| 3,900,001 | 8/1975 | Fraser et al. | 118/637 |
| 4,078,929 | 3/1978 | Sundlach | 96/1.2 |
| 4,308,821 | 1/1982 | Matsumoto et al. | 118/645 |
| 4,459,009 | 7/1984 | Hays et al. | 355/3 DD |
| 4,478,505 | 10/1984 | Tashiro | 355/3 DD |
| 4,486,089 | 12/1984 | Itaya et al. | 355/3 DD |
| 4,558,941 | 12/1985 | Nosaki et al. | 355/3 DD |
| 4,568,955 | 2/1986 | Hosoya et al. | 346/153.1 |
| 4,610,531 | 9/1986 | Hayashi et al. | 355/14 D |
| 4,647,179 | 3/1987 | Schmidlin | 355/3 DD |
| 4,669,852 | 6/1987 | Tajima et al. | 355/3 DD |
| 4,804,994 | 2/1989 | Sasaki et al. | 355/14 D X |

*Primary Examiner*—A. C. Prescott

[57] ABSTRACT

The present invention uses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

28 Claims, 3 Drawing Sheets

SCAVENGELESS DEVELOPMENT APPARATUS FOR USE IN HIGHLIGHT COLOR IMAGING

BACKGROUND OF THE INVENTION

This invention relates generally to the rendering of latent electrostatic images visible using multiple colors of dry toner or developer and more particularly to a development apparatus including a plurality of developer housings which minimize scavenging and redevelopment of the first developed image by successive developer housings.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD)stays at full photoreceptor potential ($V_{cad}$ or $V_{ddp}$). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

The viability of printing system concepts such as tri-level, highlight color xerography requires development systems that do not scavenge or interact with a previously toned image. Since commercial development systems such as magnetic brush development and jumping single component development interact with the image receiver, a previously toned image will be scavenged by subsequent development. Great care is required to optimize the development materials and process conditions for minimum interaction. Since the present commercial development systems are highly interactive with the image bearing member, there is a need for scavengeless or non-interactive development systems.

It is known in the art to alter the magnetic properties of the magnetic brush in the second housing in order to obviate the foregoing problem. For example, there is disclosed in U.S. Pat. No. 4,308,821 granted on Jan. 5, 1982 to Matsumoto, et al, an electrophotographic development method and apparatus using two magnetic brushes for developing two-color images which do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 disclosed the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3.900.001 discloses an electrostatographic developing apparatus utilized in connection with the development of conventional xerographic images. It is utilized for applying developer material to a developer receiving surface in conformity with an electrostatic charge pattern wherein the developer is transported from the developer supply to a development zone while in a magnetic brush configuration and thereafter, transported through the development zone in magnetically unconstrained blanket contact with the developer receiving surface.

As disclosed in U.S. Pat. No. 4,486,089 granted on Dec. 4, 1984 to Itaya, et. al. a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. patent application Ser. No. 095,486 discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also the developer is transported from one magnetic roll to the next. This apparatus provides an efficient means for developing the complimentary half of a tri-level latent image while at the same time allowing the already developed first half to pass through the second housing with a minimum image disturbance.

U.S. patent application Ser. No. 102,965 discloses a combination Xerographic-DEP printing apparatus wherein highlight color images are formed without scavenging and re-development of a first developed image. A first image is formed in accordance with conventional (i.e. total voltage range available) electrostatic forming techniques. A successive image is formed on the copy substrate containing the first image subsequent to the first image transfer, either before or after fusing, by utilization of direct electrostatic printing. Thus, the '965 application solves the problem of developer interaction with previously recorded images by forming a second image on the copy substrate instead of on the charge retentive surface on which the first image was formed.

U.S. Pat. No. 4,478,505 issued on October 23, 1984 relates to developing apparatus for improved charging of flying toner. The apparatus disclosed therein comprises a conveyor for conveying developer particles from developer supplying means and a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an A.C. power source to reciprocate the developer particles between the conveyor and the electrode plate thereby sufficiently and uniformly charging the developer particles by friction. In the embodiment disclosed in FIG. 6 of the '505 patent,a gird is disposed in a space between the photosensitive layer and a doner member.

U.S. Pat. No. 4,568,955 issued on February 4, 1986 to Hoyosa et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an A.C. and a D.C. source are connected to the electrodes, for generating an alternating electric field between adjacent ones of the electrodes to cause oscillations of the developer found between the adjacent electrodes along electric lines of force therebetween to thereby liberate the developer from the developing roller.

In a modified form of the Hoyosa et al device, a toner reservoir is disposed beneath a recording electrode which has a top provided with an opening facing the recording electrode and an inclined bottom for holding a quantity of toner. In the toner reservoir are disposed a toner carrying plate as the developer carrying member, secured in a position such that it faces the end of the recording electrode at a predetermined distance therefrom, and a toner agitator for agitating the toner.

The toner carrying plate is made of an insulator. The toner carrying plate has a horizontal portion, a vertical portion descending from the right end of the horizontal portion and an inclined portion downwardly inclining from the left end of the horizontal portion. The lower end of the inclined portion is found near the lower end of the inclined bottom of the toner reservoir and immersed in the toner therein. The lower end of the vertical portion is found near the upper end of the inclined portion and above the toner in the reservoir.

The surface of the toner carrying plate is provided with a plurality of uniformly spaced parallel linear electrodes extending in the width direction of the toner carrying plate. At least three AC voltages of different phases are applied to the electrodes. The three-phase AC voltage source provides three-phase AC voltages 120 degrees out of phase from one another. The terminals are connected to the electrodes in such a manner that when the three-phase AC voltages are applied, a propagating alternating electric field is generated, which propagates along the surface of the toner carrying plate from the inclined portion to the horizontal portion.

The toner which is always present on the surface of lower end of the inclined portion of the toner carrying plate is negatively charged by friction with the surface of the toner carrying plate and by the agitator. When the propagating alternating electric field is generated by the three-phase AC voltages applied to the electrodes the toner is transported up to inclined portion of the toner carrying plate while it is oscillated and liberated to be rendered into the form of smoke between adjacent linear electrodes. Eventually, it reaches the horizontal portion and proceeds therealong. When it reaches a development zone facing the recording electrode it is supplied through the opening to the ordinary sheet as recording medium, whereby a visible image is formed. The toner which has not contributed to the formation of the visible image, is carried along such as to fall along the vertical portion and then slide down into the bottom of the toner reservoir by the gravitational force to return to a zone, in which the lower end of the inclined portion of the toner.

BRIEF SUMMARY OF THE INVENTION

Briefly, the present invention uses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor.

The AC voltage can be supplied to either the electrode structure or the donor electrode. The close proximity of the electrode structure to the donor enables a reduced, relatively low AC voltage amplitude for efficient toner detachment. An AC amplitude of 200 to 300 volts peak is required compared to 1000 to 1200 volts for typical AC jumping SCD (single component development). Generation of a toner powder cloud by a self-spaced electrode structure near the donor relaxes the requirements for tight tolerances on the donor-receiver gap (on the order of 10 mils) and donor roll runout.

As will be discussed in more detail below in connection with the drawings, a preferred electrode structure configuration comprises two 3.5 mil tungsten wires separated by 0.1". The two electrodes are strung parallel to the axis of a 1¾" diameter dielectric coated donor roll. A suitable material for use as the dielectric coating is Teflon-S (trademark of E.I. du Pont de Nemours & Co. of Wilmington Delaware). The wires are self-spaced on the toner layer and were noted to conform to the donor by an average electrostatic force associated with the AC voltage. Prints were obtained with the system under the conditions of a donor bias of −200 volts DC and a wire AC voltage of 300 volts peak at 5 kHz. The donor roll was loaded with positively charged toner using a suitable toner metering/charging device. The prints were obtained with the development system in the six o'clock position in a xerographic machine operating at a process speed of 4.7 ips. The photoreceptor was charged to −400 volts and discharged −100 volts to provide an image contrast potential of −300 volts. Essentially no image development is obtained when the AC voltage is off.

Scavengeless development was demonstrated with two-color single pass development of a tri-level electrostatic latent image. The image was first discharge area developed with red toner and then discharge area developed with black toner under the conditions that the donor roll was biased midway on the photoinduced discharge curve. Thus, the high potential image was only developed by the red toner whereas the low potential image was developed by both the red and black toner. AC jumping development was used for the red toner development. AC jumping development is a development system that uses a high amplitude (800 to 1000 volts peak) AC bias which is applied between a development roll and an image receiver.

The black toner development was obtained with the scavengeless development disclosed herein. After 50 prints there was little if any contamination of the black donor roll by red toner. If the black development system was operated in the conventional AC jumping mode, there was significant contamination of the black toner by the red toner after 50 prints.

The characteristics of scavengeless development with toner AC electric field detached by an electrode structure in close proximity to a toned donor are distinctly different from conventional AC jumping development. In addition to lower AC voltages and wider development nip latitude enabled by the scavengeless system, we observed improved solid area uniformity and lower background development since the toner is not strong interactive with the receiver. The frequency response of the scavengeless system is also considerably higher (>10 kHz) compared to AC jumping (1 to 4 kHz) since the toner only has to move a distance of 2 mils to jump between the donor and electrode compared to a jumping development distance of 10 mils between the donor and receiver.

DETAILED DESCRIPTION OF THE PREFERRED EMBODIMENT OF THE INVENTION

Figure 1A:
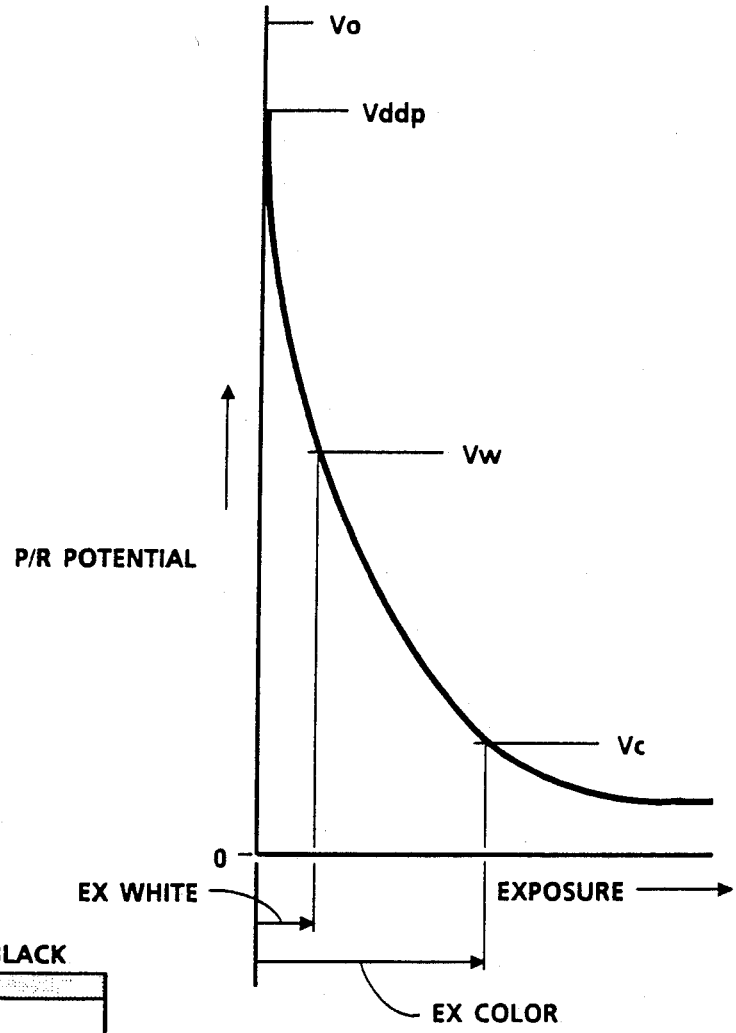
FIG. 1*a* is a plot of photoreceptor potential versus exposure illustrating a tri-level electrostatic latent image.
Figure 1B:
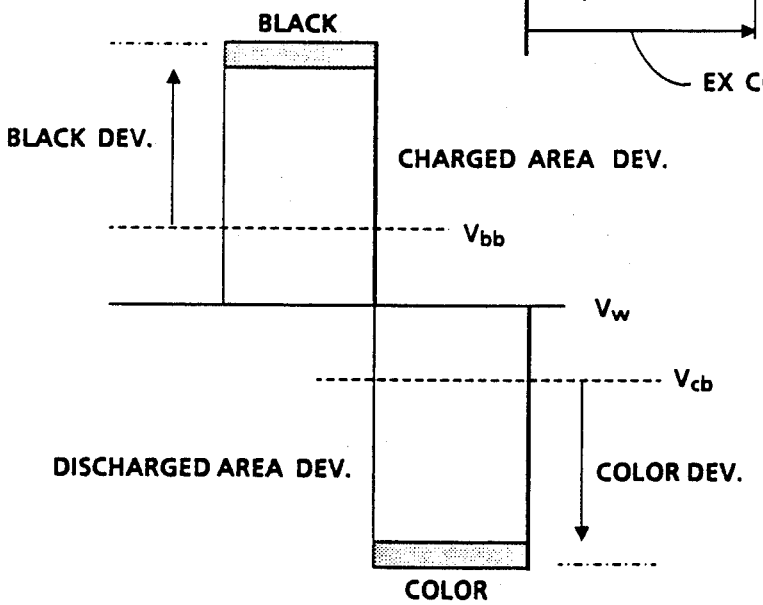
FIG. 1*b* is a plot of photoreceptor potential illustrating single-pass, highlight color latent image characteristics.

For a better understanding of the concept of tri-level, highlight color imaging, a description thereof will now be made with reference to FIGS. 1*a* and 1*b*. FIG. 1*a* illustrates the tri-level electrostatic latent image in more detail. Here $V_0$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved when passing the photoreceptor through two developer housings in tandem or in a single pass by electrically biasing the housings to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electrostatic field existing between the photoreceptor and the development rolls in the first housing at bias voltage $V_{cb}$ (V color bias).

Figure 2:
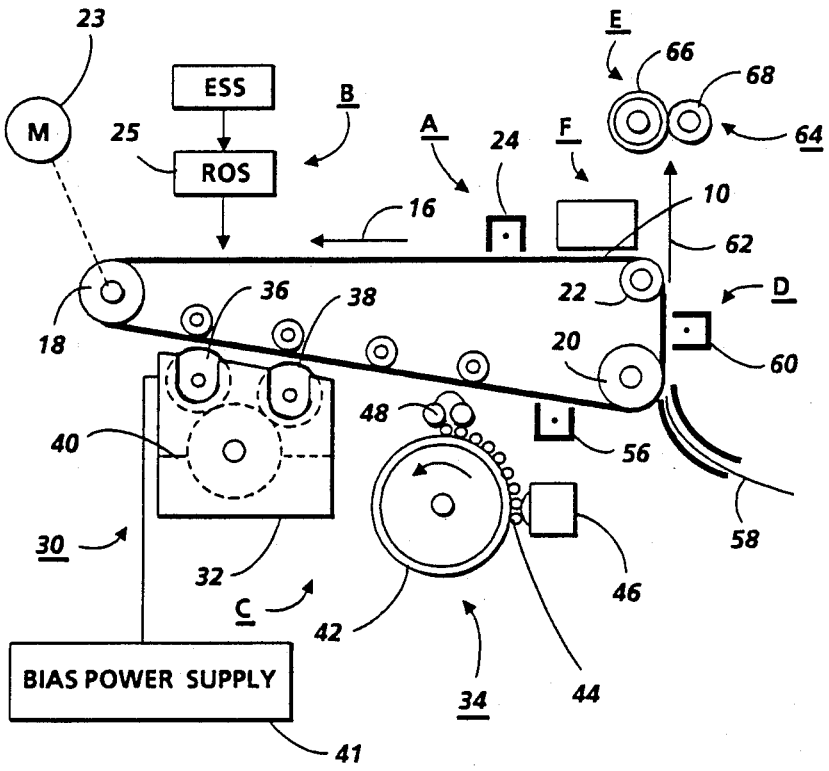
FIG. 2 is schematic illustration of a printing apparatus incorporating the inventive features of our invention.

As shown in FIG. 2, a printing machine incorporating our invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about 900 volts. When exposed at the exposure station B it is discharged to $V_c$ equal to about 100 volts which is near zero or ground potential in the highlight (i.e. color other than black) color parts of the image. See FIG. 1*a*. The photoreceptor is also discharged to $V_w$ equal to 500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains red toner. Appropriate electrical biasing is accomplished via power supply 41 electrically connected to developer apparatus 32. A DC bias of approximately 400 volts is applied to the rollers 36 and 37 via the power supply 41.

The developer apparatus 34 comprises a donor structure in the form of a roller 42. The donor structure 42 conveys single component developer 44 deposited thereon via a combination metering and charging device 46 to adjacent an electrode structure. The developer in this case comprises black toner. The donor structure can be rotated in either the 'with' or 'against' direction vis-a-vis the direction of motion of the charge retentive surface. The donor roller 42 is preferably coated with TEFLON-S (trademark of E.I. DuPont De Nemours).

The combination metering and charging device may comprise any suitable device for depositing a monolayer of well charged toner onto the donor structure 42. For example, it may comprise an apparatus such as described in U.S. Pat. No. 4,459,009 wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure.

Figure 4:
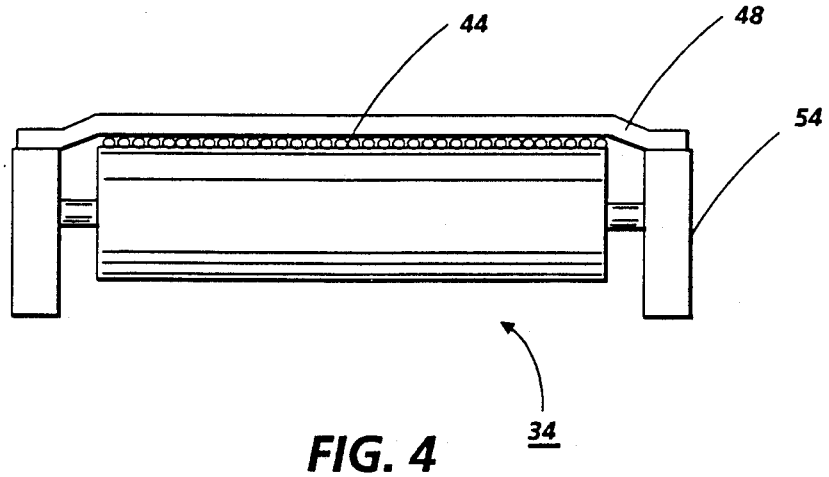
FIG. 4 is a fragmentary view from a different direction of the developer apparatus of FIG. 3.

The developer apparatus 34 further comprises an electrode structure 48 which is disposed in the space between the charge retentive surface 10 and the donor structure 42 The electrode structure is comprised of one or more thin (i.e. 50 to 100 $\mu$ diameter) tungsten wires which are lightly positioned against the donor structure 42. The distance between the wires and the donor is approximately 25 $\mu$ or the thickness of the toner layer on the donor roll. The wires, as can be seen in FIG. 4, are self-spaced from the donor structure by the thickness of the toner on the donor structure. To this end the extremities of the wires supported by the tops of end bearing blocks 54 which also support the donor structure for rotation. The wire extremities are attached so that they are slightly below a tangent to the surface, including toner layer, of the donor structure. Mounting the wires in such a manner makes them insensitive to roll runout due to their self-spacing.

Figure 3:
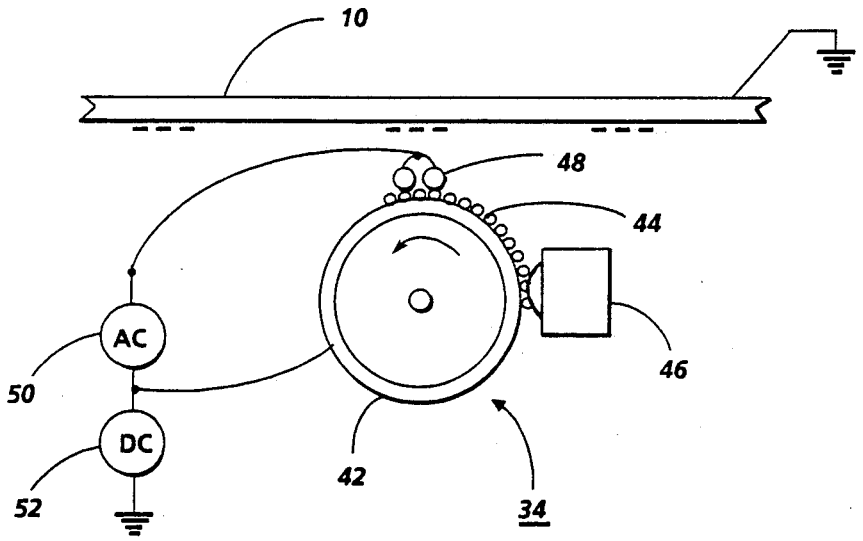
FIG. 3 is a fragmentary schematic illustration of a developer apparatus representing the present invention.

As illustrated in FIG. 3, an alternating electrical bias is applied to the electrode structure via an AC voltage source 50. The applied AC establishes an alternating electrostatic field between the wires and the donor structure which is effective in detaching toner from the surface of the donor structure and forming a toner cloud about the wires, the height of the cloud being such as not to contact with the charge retentive surface. The magnitude of the AC voltage is relatively low and is in the order of 200 to 300 volts peak at a frequency of about 4kHz up to 10 kHz. A DC bias supply 52 which applies approximately 700 volts to the donor structure 42 establishes an electrostatic field between the charge retentive surface of the photoreceptor 10 and the donor structure for attracting the detached toner particles from the cloud surrounding the wires to the latent image on the charge retentive surface. At a spacing of approximately 25 $\mu$ between the electrode and donor structures an applied voltage of 200 to 300 volts produces a relatively large electrostatic field without risk of air breakdown. The use of a dielectric coating on either of the structures helps to prevent shorting of the appllied AC voltage. The field strength produced is in the order of 8 to 12 volts/$\mu$. While the AC bias is illustrated as being applied to the electrode structure it could equally as well be applied to the donor structure.

A sheet of support material 58 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto a backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

While the developer apparatus 32 has been disclosed as a magnetic brush system, developer apparatus 34 could be used in its place. Also, while the development of discharged area images was illustrated as being effected prior to charged area development the sequence of image development can be reversed in the case where apparatus 34 is used in place of apparatus 32.

What is claimed is:

1. Apparatus for developing latent electrostatic images on a charge retentive surface with toner, said apparatus comprising:

a supply of toner;

a donor structure spaced from said charge retentive surface for conveying toner from said supply of toner to an area opposite said charge retentive surface;

an electrode structure;

means for establishing an alternating electrostatic field between said donor structure and said electrode structure;

said electrode structure being positioned in space between said charge retentive surface and said donor structure and sufficiently close to said donor structure to permit detaching of toner from the surface of said donor structure with the use of a relatively high alternating electrostatic field without risk of air breakdown to thereby produce toner clouding about said electrode structure; and means for creating an electrostatic field between said charge retentive surface and said electrode structure for effecting movement of detached toner to said latent electrostatic images.

2. Apparatus according to claim 1 wherein said means for establishing an alternating electrostatic field between said donor structure and said electrode structure comprises means for applying a relatively low electrical bias to only one of said structures.

3. Apparatus according to claim 2 wherein said relatively low alternating electrical bias is in the order of 200 to 300 volts peak.

4. Apparatus according to claim 3 wherein the frequency of said low alternating electrical bias is greater than 4 kHz.

5. Apparatus according to claim 4 wherein said donor structure comprises a roller.

6. Apparatus according to claim 5 further comprising means for supporting said electrode structure whereby spacing between said donor structure and said electrode structure is insensitive to roll runout.

7. Apparatus according to claim 6 wherein said electrode structure is self-spaced from said donor structure by a layer of toner on said donor structure.

8. Apparatus according to claim 7 wherein said electrodes comprise a plurality of small diameter wires.

9. Apparatus according to claim 8 wherein said toner layer is approximately 25 $\mu$ and said wires have a diameter in the order of 50 to 100 $\mu$.

10. Apparatus according to claim 9 wherein one of said structures is coated with a dielectric material.

11. Apparatus for forming latent electrostatic images on a charge retentive surface and rendering them visible with black and at least one highlight color toner in a single pass of the imaging surface through the processing areas of a printing system, said apparatus comprising:

first and second developer apparatuses for applying toner particles to said latent electrostatic images, said apparatuses being arranged so said images are moved past said first apparatus prior to moving past said second apparatus;

said second developer apparatus including:

a supply of toner;

a donor structure spaced from said charge retentive surface for conveying toner from said supply of toner to an area opposite said charge retentive surface;

an electrode structure;

means for establishing an alternating electrostatic field between said donor structure and said electrode structure;

said electrode structure being positioned in a space between said charge retentive surface and said donor structure and sufficiently close to said donor structure to permit detaching of toner from the surface of said donor structure with the use of a relatively high alternating electrostatic field without risk of air breakdown to thereby produce toner clouding about said electrode structure; and means for creating an electrostatic field between said charge retentive surface and said electrode structure for effecting movement of detached toner to said latent electrostatic images.

12. Apparatus according to claim 11 wherein said means for establishing an alternating electrostatic field between said donor structure and said electrode structure comprises means for applying a relatively low electrical bias to only one of said structures.

13. Apparatus according to claim 12 wherein said relatively low alternating electrical bias is in the order of 200 to 300 volts peak.

14. Apparatus according to claim 13 wherein the frequency of said low alternating electrical bias is greater than 4 kHz.

15. Apparatus according to claim 14 wherein said donor structure comprises a roller.

16. Apparatus according to claim 15 further comprising means for supporting said electrode structure whereby spacing between said donor and said electrode structure is insensitive to roll runout.

17. Apparatus according to claim 16 wherein said electrode structure is self-spaced from said donor structure by a layer of toner on said donor structure.

18. Apparatus according to claim 17 wherein said electrodes comprise a plurality of small wires.

19. Apparatus according to claim 18 wherein said toner layer is approximately 25 μ and said wires have a diameter in the order of 50 100 μ.

20. Apparatus according to claim 19 wherein one of said structures is coated with a dielectric material.

21. The method of forming highlight color images on a charge retentive surface containing at least two image areas, said method including the steps of:

providing first and second developer apparatuses;

positioning a donor structure of said second developer apparatus adjacent said charge retentive surface;

positioning an electrode structure between said charge retentive surface and said donor structure and spacing it a relatively short distance from the latter;

depositing a monolayer of well charged toner on said donor structure;

applying a relatively low alternating electrical bias to one of said structures to establish a relatively high alternating electrostatic field between said donor structure and said electrode structure to effect detachment of said toner from said donor structure to thereby form a cloud of toner around said electrode structure;

establishing an electrostatic field between said charge retentive surface and said donor structure for effecting movement of toner to said charge retentive surface to thereby render some of said latent electrostatic images visible; and moving said charge retentive surface past said first and second developer apparatuses in that order.

22. The method according to claim 21 wherein the step of establishing a relatively high electrostatic field comprises applying an alternating electrical bias voltage in the order of 200 to 300 volts peak to one of said structures.

23. The method according to claim 22 wherein said alternating electrical bias is applied at a frequency in the order of 4 to 10 kHz.

24. The method according to claim 23 wherein said electrode structure comprises a plurality of small diameter wires.

25. The method according to claim 24 including the step of spacing said wires from said donor structure by said layer of toner.

26. The method according to claim 25 wherein said toner layer is approximately 25 μ and said wires have a diameter in the order of 50 to 100 μ.

27. The method according to claim 26 including the step of coating one of said structures with a dielectric material.

28. The method according to claim 27 including the step of providing a roller as said donor structure.

* * * * *